US006924769B2

(12) United States Patent
Ito et al.

(10) Patent No.: US 6,924,769 B2
(45) Date of Patent: Aug. 2, 2005

(54) ANTENNA FOR COMMUNICATION TERMINAL APPARATUS

(75) Inventors: Hideo Ito, Machida (JP); Kiyoshi Egawa, Minato-ku (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 13 days.

(21) Appl. No.: 10/468,599

(22) PCT Filed: Dec. 27, 2002

(86) PCT No.: PCT/JP02/13772

§ 371 (c)(1),
(2), (4) Date: Aug. 20, 2003

(87) PCT Pub. No.: WO03/056658

PCT Pub. Date: Jul. 10, 2003

(65) Prior Publication Data

US 2004/0066341 A1 Apr. 8, 2004

(30) Foreign Application Priority Data

Dec. 27, 2001 (JP) ..... 2001-398231

(51) Int. Cl.[7] ..... H01Q 1/24
(52) U.S. Cl. ..... 343/702
(58) Field of Search ..... 343/702, 700 MS, 343/833

(56) References Cited

U.S. PATENT DOCUMENTS

| | | | | |
|---|---|---|---|---|
| 5,966,097 | A | 10/1999 | Fukasawa et al. | |
| 6,300,909 | B1 | 10/2001 | Tsubaki et al. | 343/700 MS |
| 6,317,089 | B1 * | 11/2001 | Wilson et al. | 343/713 |
| 6,433,746 | B2 * | 8/2002 | Kushihi et al. | 343/700 MS |
| 6,476,767 | B2 * | 11/2002 | Aoyama et al. | 343/700 MS |
| 6,515,627 | B2 * | 2/2003 | Lopez et al. | 343/700 MS |
| 6,542,124 | B1 * | 4/2003 | Yoon | 343/700 MS |
| 6,600,449 | B2 * | 7/2003 | Onaka et al. | 343/700 MS |
| 6,614,398 | B2 * | 9/2003 | Kushihi et al. | 343/700 MS |
| 6,618,011 | B2 * | 9/2003 | Eggleston et al. | 343/700 MS |
| 2003/0034917 | A1 | 2/2003 | Nishizawa et al. | 343/700 MS |

FOREIGN PATENT DOCUMENTS

| | | |
|---|---|---|
| JP | 50147258 | 11/1975 |
| JP | 61205004 | 9/1986 |
| JP | 06069715 | 3/1994 |
| JP | 06232625 | 8/1994 |
| JP | 07131241 | 5/1995 |
| JP | 9326632 | 12/1997 |
| JP | 10051223 | 2/1998 |
| JP | 11004117 | 1/1999 |
| JP | 11068449 | 3/1999 |
| JP | 11136020 | 5/1999 |
| JP | 11274845 | 10/1999 |
| JP | 2000068726 | 3/2000 |
| JP | 2001168634 | 6/2001 |
| JP | 2001185938 | 7/2001 |
| WO | 0148866 | 7/2001 |

OTHER PUBLICATIONS

International Search Report dated Feb. 12, 2003.

* cited by examiner

*Primary Examiner*—Don Wong
*Assistant Examiner*—Huedung X. Cao
(74) *Attorney, Agent, or Firm*—Stevens, Davis, Miller & Mosher, LLP

(57) ABSTRACT

The unbalanced feeding antenna element 201 is fed power from one end and placed on the upper surface of the circuit substrate 103. The passive element 202 has open both ends, is set to a length corresponding to a predetermined frequency, placed in substantially parallel to the unbalanced feeding element 201 placed on the circuit substrate 103 at a distance of approximately 1/10 or less of a wavelength at a frequency used for transmission/reception. This suppresses the antenna current flowing into the circuit substrate 103 to a minimum level and makes radiation from the passive element 202 dominant compared to radiation from the circuit substrate 103. This makes it possible to suppress a reduction in the antenna gain caused by the human body when the user uses the communication terminal apparatus.

3 Claims, 18 Drawing Sheets

ANTENNA FOR COMMUNICATION TERMINAL APPARATUS

TECHNICAL FIELD

The present invention relates to an antenna used for a radio set and portable terminal, etc., and is applicable as a built-in antenna for a radio set and portable terminal, etc.

BACKGROUND ART

FIG. 1 illustrates a configuration of an antenna for a conventional cellular phone. An unbalanced feeding antenna in FIG. 1 is provided with a circuit substrate 11 and an unbalanced feeding antenna element 12.

The unbalanced feeding antenna element 12 operates as an exciter to excite the circuit substrate 11 rather than an antenna. Therefore, an antenna current flows into the circuit substrate 11, which makes the circuit substrate 11 dominant as the antenna. FIG. 2 shows a radiation characteristic using this unbalanced feeding antenna.

FIG. 2 shows a radiation characteristic of a conventional antenna for a cellular phone. Suppose the size of the circuit substrate 11 is 146×45 mm, the length of the unbalanced feeding antenna element 12 is 32 mm and its frequency is 2 GHz. In this case, radiation characteristics of $E\phi$ and $E\theta$ on a free space horizontal plane (x-y plane: see the coordinate axis in FIG. 1) are as shown in the figure and $E\theta$ shows almost no directivity because the circuit substrate 11 is operating dominantly as the antenna.

However, the problem of the cellular phone using the above-described conventional antenna for a cellular phone is that it is easily influenced by the user, resulting in a reduction in the gain. That is, assuming that the user 21 uses a cellular phone 22 as shown in FIG. 3, the circuit substrate 11 is operating dominantly as an antenna, but it is greatly influenced by the user's hand or body, etc., and the radiation characteristic when the user is operating the cellular phone is as shown in FIG. 4. In FIG. 4, the user exists in the direction indicating 270° from the origin and it is observable that the gain has decreased drastically compared to the radiation characteristic in FIG. 2.

Furthermore, FIG. 5 shows a diversity antenna used for a cellular phone and is provided with a circuit substrate 11, an unbalanced feeding antenna element 12 and a dipole antenna 31. The diversity antenna is constructed of the unbalanced feeding antenna element 12 and dipole antenna 31 and has the same problem as that described above when the unbalanced feeding antenna element 12 is operating.

DISCLOSURE OF INVENTION

It is an object of the present invention to provide an antenna for a communication terminal apparatus that suppresses a reduction in the antenna gain caused by the human body when the user uses a cellular phone.

BEST MODE FOR CARRYING OUT THE INVENTION

An essence of the present invention is to suppress a reduction in an antenna gain caused by the human body by placing a passive element having a length corresponding to a frequency used for transmission/reception at a distance of 1/10 or less of the wave length of the frequency used for transmission/reception substantially in parallel to an unbalanced feeding antenna element so that radiations from the passive element becomes dominant.

With reference now to the attached drawings, embodiments of the present invention will be explained below.

(Embodiment 1)

Figure 6:
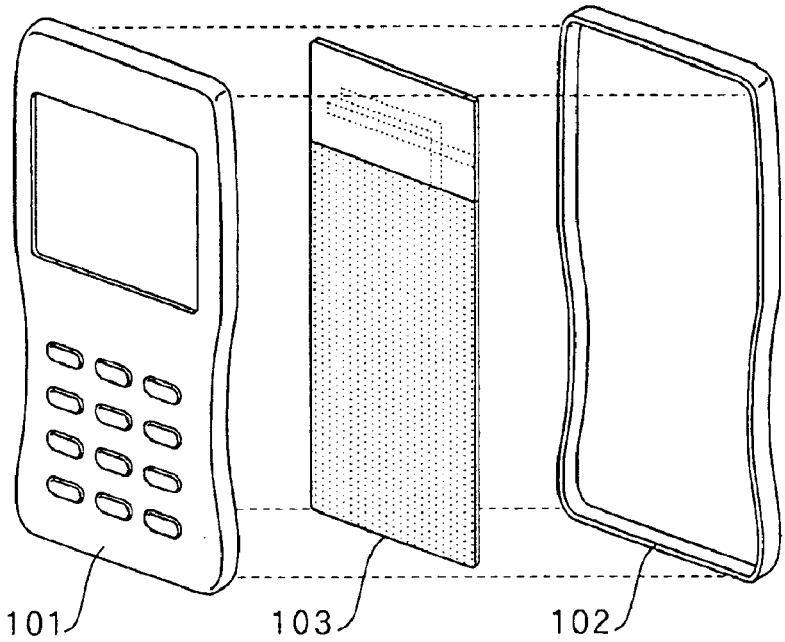
FIG. 6 is an exploded perspective view of a cellular phone according to Embodiment 1 of the present invention.

FIG. 6 is an exploded perspective view of a cellular phone according to Embodiment 1 of the present invention. In FIG. 6, the cellular phone is provided with a front case 101 and a rear case 102 which serve as a housing, and a circuit substrate 103.

The front case 101 and rear case 102 are made of plastics, etc., and combined in such a way as to contain a circuit substrate 103 to form the housing.

The shaded area of the circuit substrate 103 is provided with a circuit for implementing the function of a cellular phone such as a reception apparatus and transmission apparatus. The upper section of the shaded area facing the rear case 102 (position corresponding to the upper section of the cellular phone) is provided with the respective antenna elements. When the cellular phone is used, the user's head is located on the front case 101 side, and therefore it is possible to avoid a reduction of the gain by radiating radio wave toward the rear case 102. The configuration of each antenna element will be explained below.

Figure 7:
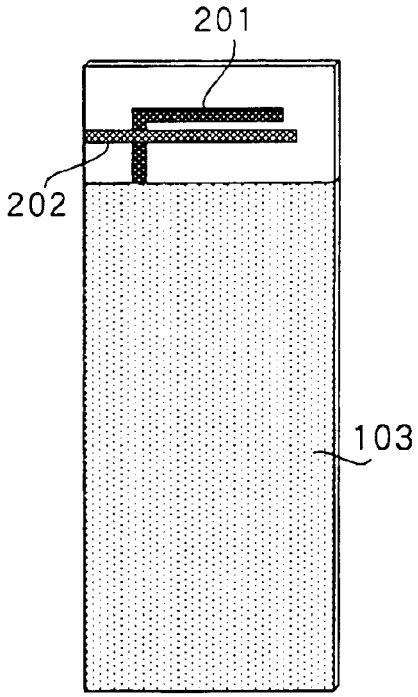
FIG. 7 is a diagram of a cellular phone antenna according to Embodiment 1 of the present invention.

FIG. 7 is a diagram of a cellular phone antenna according to Embodiment 1 of the present invention. The cellular phone antenna shown in FIG. 7 is provided with a circuit substrate 103, an unbalanced feeding antenna element 201 and a passive element 202 and these elements are provided close to a place distant from the gripper of the cellular phone (e.g., position corresponding to the upper section of the cellular phone).

The unbalanced feeding antenna element 201 is bent at a quasi-right angle and its one end is connected to a feeding point (not shown) on the circuit substrate 103. Furthermore, one side connected to the feeding point is placed substantially perpendicular to the width direction of the circuit substrate 103.

With both ends left open, the passive element 202 is set to a length of resonance with the frequency used for transmission/reception (hereinafter referred to as an "operating frequency") and the passive element 202 is placed in substantially parallel to the width direction of the circuit substrate 103 at a distance of approximately 1/10 or less of the operating frequency from the unbalanced feeding antenna element 201. Here, that both ends are open means that both ends are not connected to the circuit.

Then, the operation of the cellular phone antenna in the above-described configuration will be explained. The unbalanced feeding antenna element 201 is mainly operated as an excitation element. Since the passive element 202 is set to a length of resonance with the operating frequency, it resonates when the unbalanced feeding antenna element 201 is excited and operates as a primary antenna. This is because the passive element 202 is close to the unbalanced feeding antenna element 201 and radiation from the passive element 202 becomes dominant, which allows the current flowing into the circuit substrate 103 to be suppressed to a minimum level. In this way, when the user uses the cellular phone, this reduces radiation from the portion held by the hand (circuit substrate 103), and on the contrary, it can enhance radiation from the upper section of the cellular phone which is less affected by the human body.

Thus, the cellular phone antenna of Embodiment 1 places the passive element close to the unbalanced feeding antenna element substantially in parallel thereto and places it at a position distant from the gripper of the cellular phone, and can thereby implement an antenna with horizontal polarization in which radiation from the passive element is dominant compared to radiation from the circuit substrate and suppress a reduction in the antenna gain caused by the human body even when the cellular phone is used.

(Embodiment 2)

Figure 8:
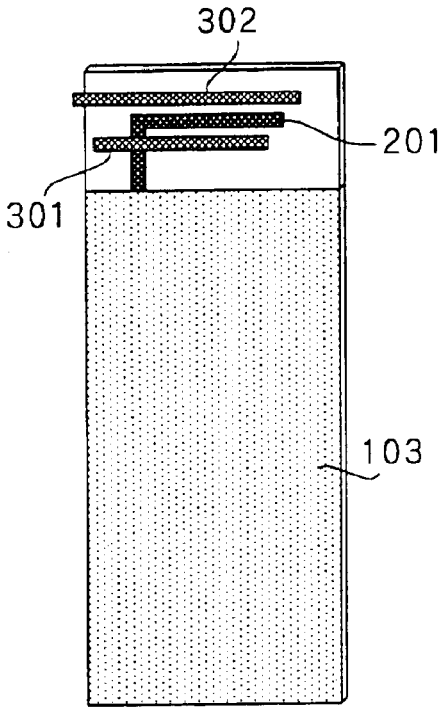
FIG. 8 is a diagram of a cellular phone antenna according to Embodiment 2 of the present invention.

FIG. 8 is a diagram of a cellular phone antenna according to Embodiment 2 of the present invention. In FIG. 8, parts common to those in FIG. 7 are assigned the same reference numerals as those in FIG. 7 and detailed explanations thereof will be omitted.

FIG. 8 differs from FIG. 7 in that two passive elements 301 and 302 of different lengths are provided instead of the passive element 202 in FIG. 7.

With both ends left open, the passive element 301 is set to a length of resonance with a certain operating frequency and placed in substantially parallel to the width direction of the circuit substrate 103 at a distance of approximately 1/10 of the operating frequency from the unbalanced feeding antenna element 201.

With both ends left open, the passive element 302 is set to a length of resonance with an operating frequency which is different from that of the passive element 301 and placed in substantially parallel to the width direction of the circuit substrate 103 at a distance of approximately 1/10 or less of the operating frequency which is different from that used by the passive element 301 from the unbalanced feeding antenna element 201.

Then, the operation of the cellular phone antenna in the above-described configuration will be explained. The unbalanced feeding antenna element 201 is mainly operated as an excitation element. The passive element 301 and passive element 302 resonate with the excitation of the unbalanced feeding antenna element 201 and operate as primary antennas. Here, since these antenna elements have different element lengths, this embodiment can also be applied to a communication system using two frequencies. Furthermore, the passive elements 301 and 302 are close to the unbalanced feeding antenna element 201, and therefore radiation from the passive element 301 or 302 becomes dominant, which allows the current flowing into the circuit substrate 103 to be suppressed to a minimum level. In this way, when the user uses the cellular phone, this reduces radiation from the portion held by the hand (circuit substrate 103), and on the contrary, it can enhance radiation from the upper section of the cellular phone which is less affected by the human body.

Thus, unlike Embodiment 1, the cellular phone antenna according to Embodiment 2 is provided with two passive elements of different lengths, and can thereby realize an antenna with horizontal polarization producing resonance at two frequencies and since radiation from the passive elements is dominant compared to radiation from the circuit substrate, it is also possible to suppress a reduction in the antenna gain caused by the human body when the cellular phone is used.

(Embodiment 3)

Figure 9:
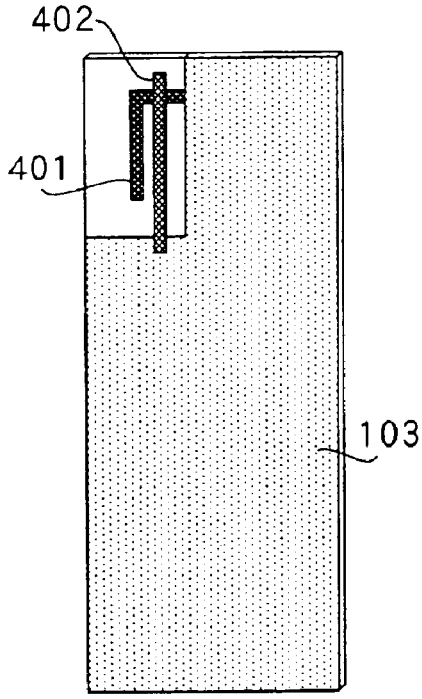
FIG. 9 is a diagram of a cellular phone antenna according to Embodiment 3 of the present invention.

FIG. 9 is a diagram of a cellular phone antenna according to Embodiment 3 of the present invention. The cellular phone antenna shown in FIG. 9 is provided with a circuit substrate 103, an unbalanced feeding antenna element 401 and a passive element 402 and these elements are provided close to positions corresponding to the upper section of the cellular phone.

The shaded area of the circuit substrate 103 is provided with circuits to implement the functions of the cellular phone such as a reception apparatus and transmission apparatus.

The unbalanced feeding antenna element 401 is bent at a quasi-right angle and one end thereof is connected to a feeding point (not shown) on the circuit substrate. Furthermore, one side connected to the feeding point is placed substantially perpendicular to the longitudinal direction of the circuit substrate 103.

With both ends left open, the passive element 402 is set to a length of resonance with an operating frequency and placed in substantially parallel to the longitudinal direction of the circuit substrate 103 at a distance of approximately 1/10 or less of the operating frequency from the unbalanced feeding antenna element 401.

Then, the operation of the cellular phone antenna in the above-described configuration will be explained. The unbalanced feeding antenna element 401 is mainly operated as an excitation element. The passive element 402 is set to a length of resonance with the operating frequency, and therefore it resonates when the unbalanced feeding antenna element 401 is excited and operates as a primary antenna. This is because the passive element 402 is close to the unbalanced feeding antenna element 401, and radiation from the passive element 402 becomes dominant, which allows the current flowing into the circuit substrate 103 to be suppressed to a minimum level. In this way, when the user uses the cellular phone, this reduces radiation from the portion held by the hand, and on the contrary, it can enhance radiation from the upper section of the cellular phone which is less affected by the human body.

Thus, unlike Embodiment 1, the cellular phone antenna according to Embodiment 3 places the unbalanced feeding antenna element and passive element substantially in parallel to the longitudinal direction of the cellular phone, and can thereby realize an antenna with vertical polarization in which radiation from the passive element becomes dominant compared to radiation from the circuit substrate and also suppress a reduction in the antenna gain caused by the human body when the cellular phone is used.

(Embodiment 4)

Figure 10:
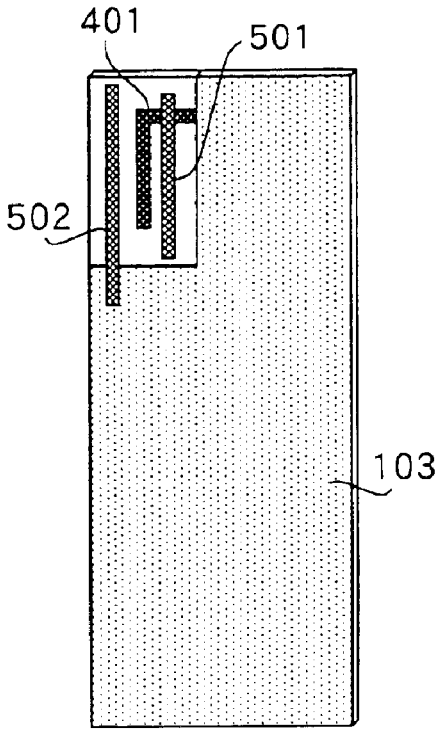
FIG. 10 is a diagram of a cellular phone antenna according to Embodiment 4 of the present invention.

FIG. 10 is a diagram of a cellular phone antenna according to Embodiment 4 of the present invention. In FIG. 10, parts common to those in FIG. 9 are assigned the same reference numerals as those in FIG. 9 and detailed explanations thereof will be omitted.

FIG. 10 differs from FIG. 9 in that two passive elements 501 and 502 of different lengths are provided instead of the passive element 402 in FIG. 9.

With both ends left open, the passive element 501 is set to a length of resonance with a certain operating frequency and placed in substantially parallel to the longitudinal direction of the circuit substrate 103 at a distance of approximately 1/10 or less of the operating frequency from the unbalanced feeding antenna element 401.

With both ends left open, the passive element 502 is set to a length of resonance with an operating frequency which is different from that of the passive element 501 and placed in substantially parallel to the longitudinal direction of the circuit substrate 103 at a distance of approximately 1/10 or less of the operating frequency, which is different from that used by the passive element 501, from the unbalanced feeding antenna element 401.

Then, the operation of the cellular phone antenna in the above-described configuration will be explained. The unbalanced feeding antenna element 401 is mainly operated as an excitation element. The passive element 501 and passive element 502 resonate when the unbalanced feeding antenna element 401 is excited and operate as primary antennas. Here, since these antenna elements have different element lengths, they can handle two frequencies and radiate in a communication system using two frequencies. Furthermore, the passive elements 501 and 502 are close to the unbalanced feeding antenna element 401, and therefore radiation from the passive element 501 or 502 becomes dominant, which allows the current flowing into the circuit substrate 103 to be suppressed to a minimum level. In this way, when the user uses the cellular phone, this reduces radiation from the portion held by the hand (circuit substrate 103), and on the contrary, it can enhance radiation from the upper section of the cellular phone which is less affected by the human body.

Thus, unlike Embodiment 3, the cellular phone antenna according to Embodiment 4 is provided with two passive elements, and can thereby realize an antenna with vertical polarization having resonance with two frequencies and since radiation from the passive elements is dominant compared to radiation from the circuit substrate, it is also possible suppress a reduction in the antenna gain caused by the human body when the cellular phone is used.

(Embodiment 5)

Figure 11:
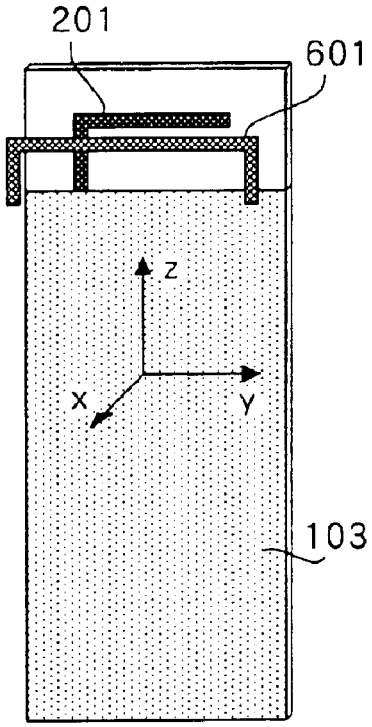
FIG. 11 is a diagram of a cellular phone antenna according to Embodiment 5 of the present invention.

FIG. 11 is a diagram of a cellular phone antenna according to Embodiment 5 of the present invention. In FIG. 11, parts common to those in FIG. 7 are assigned the same reference numerals as those in FIG. 7 and detailed explanations thereof will be omitted.

FIG. 11 differs from FIG. 7 in that the passive element 202 in FIG. 7 is replaced by a passive element 601 which is bent at a quasi-right angle at a predetermined distance from both ends.

The cellular phone antenna shown in FIG. 11 is provided with a circuit substrate 103, an unbalanced feeding antenna element 201 and a passive element 601 and these elements are provided close to the end in the width direction of the circuit substrate 103.

With both ends left open, the passive element 601 is bent at a quasi-right angle at a predetermined distance from both ends and set to a length of resonance with an operating frequency and the side not including open both ends is placed in substantially parallel to the longitudinal direction of the circuit substrate 103 at a distance of approximately 1/10 or less of the wavelength at the operating frequency from the unbalanced feeding antenna element 201.

Then, the operation of the cellular phone antenna in the above-described configuration will be explained. The unbalanced feeding antenna element 201 is mainly operated as an excitation element. Since the width direction and longitudinal direction of the circuit substrate 103 are set to a length of resonance with the operating frequency, the passive element 601 resonates with the excitation of the unbalanced feeding antenna element and operates as a primary antenna with vertical and horizontal polarizations. This is because the passive elements 601 is close to the unbalanced feeding antenna element 201, and therefore radiation from the passive element 601 becomes dominant, which allows the current flowing into the circuit substrate 103 to be suppressed to a minimum level. In this way, when the user uses the cellular phone, this reduces radiation from the portion held by the hand (circuit substrate 103), and on the contrary, it can enhance radiation from the upper section of the cellular phone which is less affected by the human body.

Figure 1:
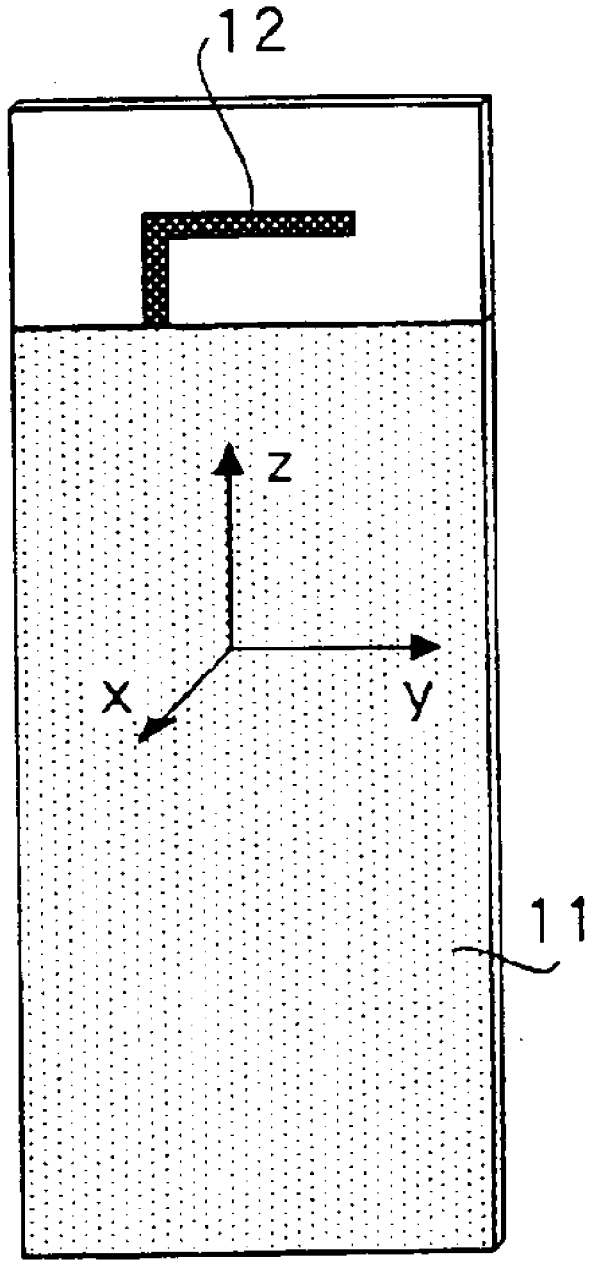
FIG. 1 RELATED ART
FIG. 1 is a diagram of a conventional cellular phone antenna.
Figure 2:
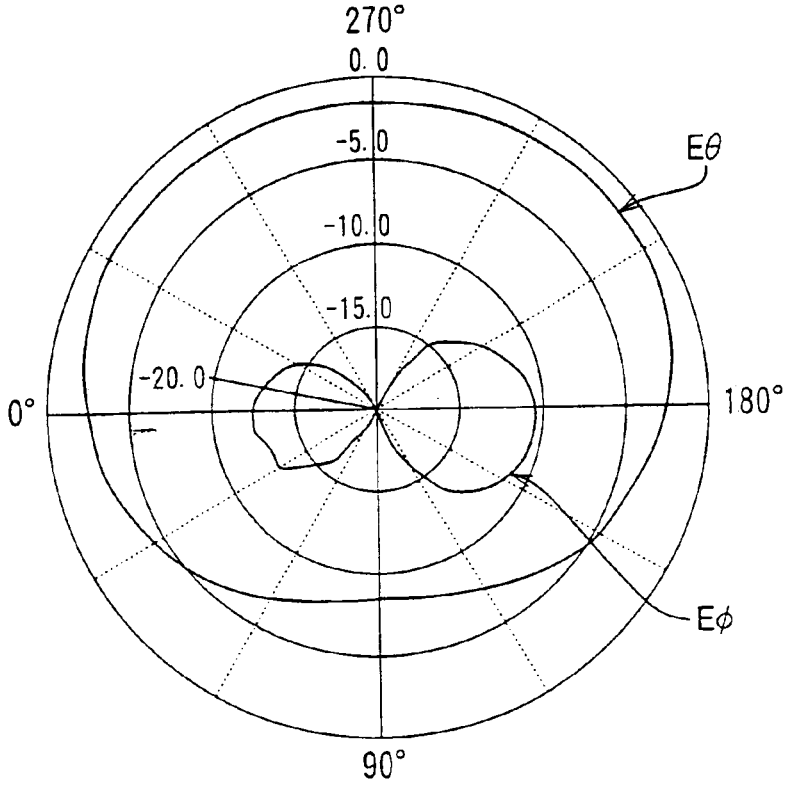
FIG. 2 RELATED ART
FIG. 2 is a radiation characteristic diagram of the conventional cellular phone antenna.
Figure 3:
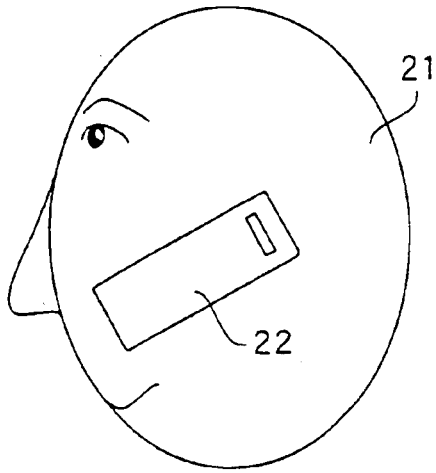
FIG. 3 RELATED ART
FIG. 3 illustrates a situation in which a cellular phone is used.
Figure 4:
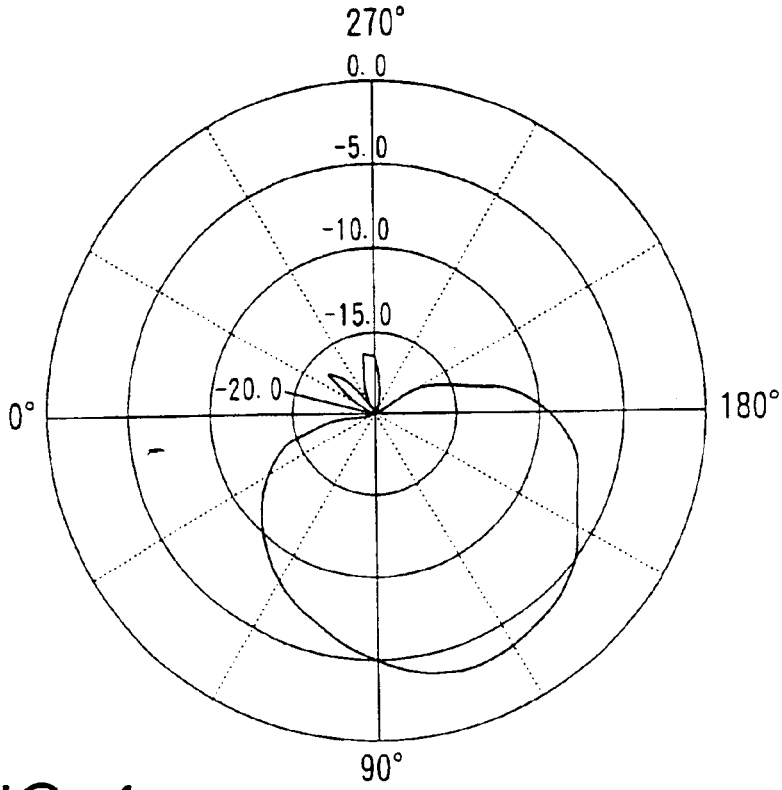
FIG. 4 RELATED ART
FIG. 4 is a radiation characteristic diagram when a conventional cellular phone is used.
Figure 5:
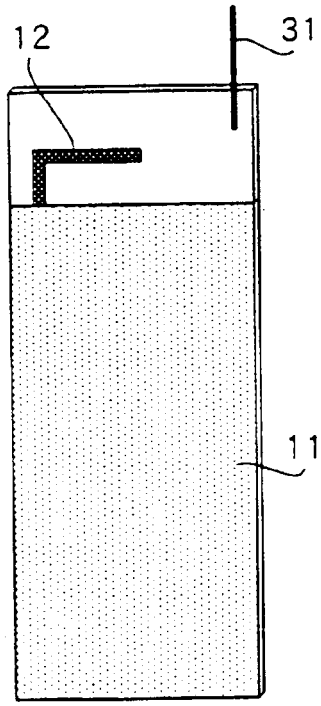
FIG. 5 RELATED ART
FIG. 5 is a diagram of a conventional diversity antenna.
Figure 12:
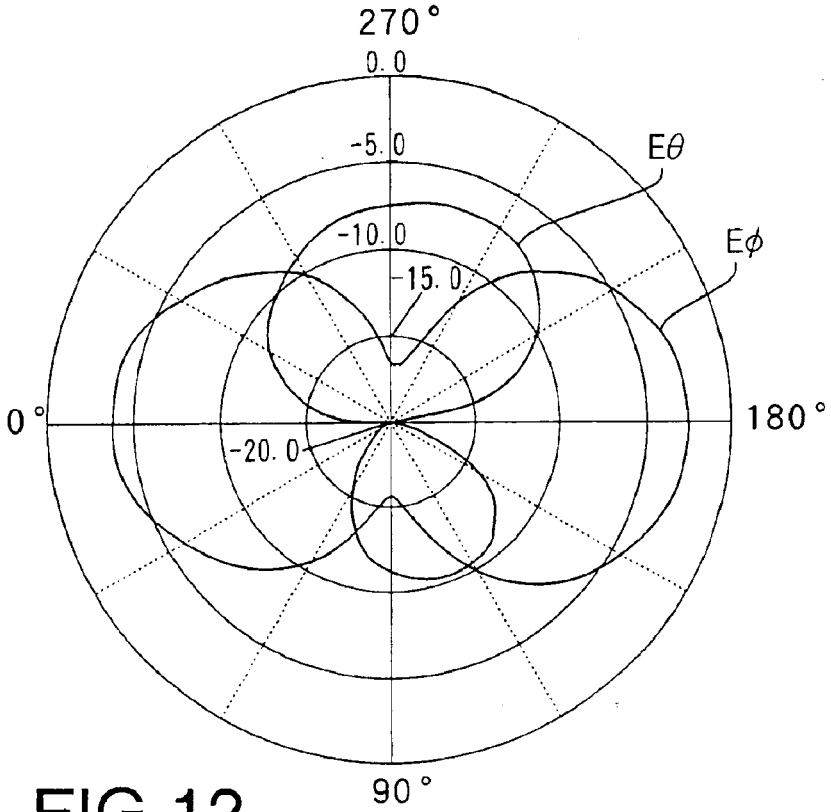
FIG. 12 is a radiation characteristic diagram of the cellular phone antenna according to Embodiment 5 of the present invention.
Figure 13:
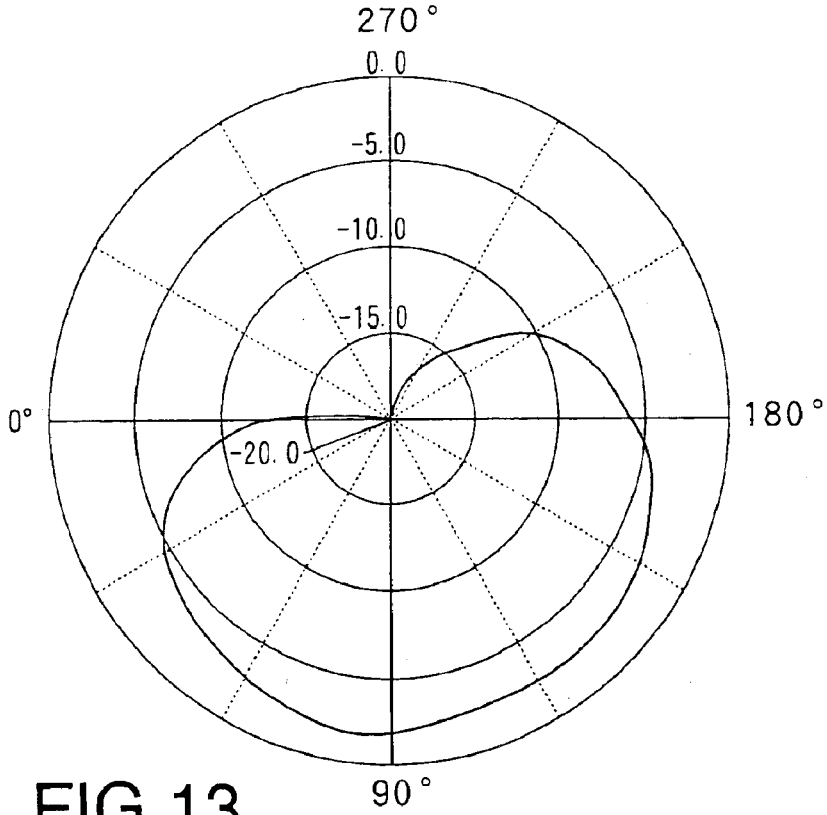
FIG. 13 is a radiation characteristic diagram when the cellular phone antenna according to Embodiment 5 of the present invention is used.

The radiation characteristic of the cellular phone antenna in this embodiment is shown in FIG. 12. Suppose the size of the circuit substrate is 146×45 mm, the length of the unbalanced feeding antenna element is 31.5 mm, the length of the passive element in the width direction of the circuit substrate is 41.5 mm and the length in the longitudinal direction is 12 mm. Here, for convenience of explanation, the coordinate axis in FIG. 11 will be used for explanations. Suppose the origin of the coordinate axis is located on the plane of the circuit substrate, the X-axis indicates the direction perpendicular to the plane of the circuit substrate, the Y-axis indicates the width direction of the plane of the circuit substrate and the Z-axis indicates the longitudinal direction of the plane of the circuit substrate. Suppose the passive element is located at a distance of 2 mm in the X-axis direction and 2.5 mm in the Z-axis direction from the unbalanced feeding antenna element and has a frequency of 2 GHz. In this case, the radiation characteristics of Eϕ and Eθ on the free space horizontal plane (X-Y plane) is as shown in FIG. 12 and among radiations from the antennas, radiation from the passive element 601 becomes dominant. The Eϕ component is radiation from the horizontal portion of the passive element 601 and the Eθ component is radiation from the vertical portion of the passive element 601 and both have vertical and horizontal polarizations showing an "8"-figured characteristic. It is apparent that the antenna current that flows into the circuit substrate 103 is suppressed to a minimum level compared to the conventional example. Therefore, when the user holds the cellular phone by hand as shown in FIG. 3, it is hardly affected by the human body and the radiation characteristic at that time is as shown in FIG. 13 and a higher gain than the conventional example in FIG. 4 can be obtained.

Thus, unlike Embodiment 1, the cellular phone antenna according to Embodiment 5 is bent at a quasi-right angle at a predetermined distance from both ends of the passive element, and can thereby realize an antenna with vertical and horizontal polarizations in which radiation from the passive element is dominant compared to radiation from the circuit substrate, also suppress a reduction in the antenna gain caused by the human body when the cellular phone is used and obtain a high gain.

(Embodiment 6)

Figure 14:
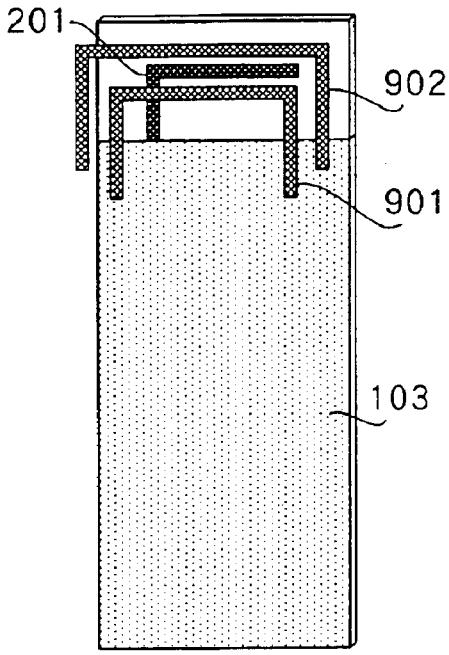
FIG. 14 is a diagram of a cellular phone antenna according to Embodiment 6 of the present invention.

FIG. 14 is a diagram of a cellular phone antenna according to Embodiment 6 of the present invention. However, parts in FIG. 14 common to those in FIG. 11 are assigned the same reference numerals as those in FIG. 11 and detailed explanations thereof will be omitted.

FIG. 14 differs from FIG. 11 in that two passive elements 901 and 902 of different lengths are provided instead of the passive element 601 in FIG. 11.

With both ends left open, the passive element 901 is bent at a quasi-right angle at a predetermined distance from both ends, set to a length of resonance with a certain operating frequency and the side not including open both ends is placed in substantially parallel to the width direction of the circuit substrate 103 at a distance of approximately 1/10 or less of the wavelength at the operating frequency from the unbalanced feeding antenna element 201.

With both ends left open, the passive element 902 is bent at a quasi-right angle at a predetermined distance from both ends, set to a length of resonance with an operating frequency which is different from that of the passive element 901 and the side not including open both ends is placed in substantially parallel to the width direction of the circuit substrate 103 at a distance of approximately 1/10 or less of the wavelength at the operating frequency which is different from the frequency used by the passive element 901 from the unbalanced feeding antenna element.

Then, the operation of the cellular phone antenna in the above-described configuration will be explained. The unbalanced feeding antenna element 201 is mainly operated as an excitation element. The passive element 901 and passive element 902 resonate with the excitation of the unbalanced feeding antenna element 201 and operate as primary antennas. Here, since these antenna elements have different element lengths, they can handle two frequencies and also radiate in a communication system using two frequencies. Furthermore, the passive elements 901 and 902 are located close to the unbalanced feeding antenna element 201, and therefore radiation from the passive element 901 or 902 becomes dominant, which allows the current flowing into the circuit substrate 103 to be suppressed to a minimum level. In this way, when the user uses the cellular phone, this reduces radiation from the portion held by the hand (circuit substrate 103), and on the contrary, it can enhance radiation from the upper section of the cellular phone which is less affected by the human body.

Figure 15:
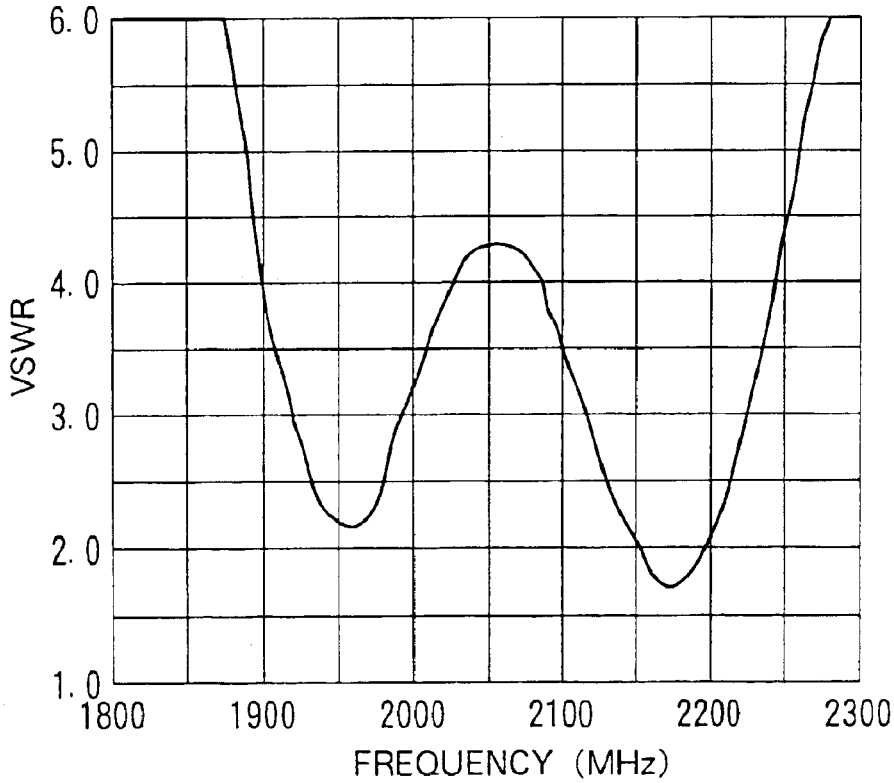
FIG. 15 is an impedance characteristic diagram of the cellular phone antenna according to Embodiment 6 of the present invention.

An impedance characteristic of the cellular phone antenna of this embodiment is shown in FIG. 15. Suppose the size of the circuit substrate 103 is 146×45 mm, the length of the unbalanced feeding antenna element 201 is 31.5 mm, the length of the passive element 901 in the width direction of the circuit substrate 103 is 41.5 mm and the length in the longitudinal direction is 10 mm, the length of the passive element 902 in the width direction of the circuit substrate is 41.5 mm and the length in the longitudinal direction is 12 mm. Suppose the passive element 902 is located at a distance of 2 mm in the X-axis direction and 2.5 mm in the Z-axis direction from the unbalanced feeding antenna element 201 and the passive element 901 is located at a distance of 2 mm in the X-axis direction and −2.5 mm in the Z-axis direction from the unbalanced feeding antenna element 201. (For the setting of the coordinate axis, see FIG. 11.)

In FIG. 15, the vertical axis shows VSWR (voltage standing wave ratio) and the horizontal axis shows the frequency (MHz). As is apparent from this characteristic diagram, this embodiment has resonance points at two frequencies with excellent impedance matching, realizing a double-frequency antenna.

Thus, unlike Embodiment 5, the cellular phone antenna according to Embodiment 6 provides two passive elements of different lengths, and can thereby realize an antenna with vertical and horizontal polarizations having two resonant frequencies, and since radiation from the passive elements become dominant compared to radiation from the circuit substrate, it is also possible to suppress a reduction in the antenna gain caused by the human body when the cellular phone is used.

(Embodiment 7)

Figure 16:
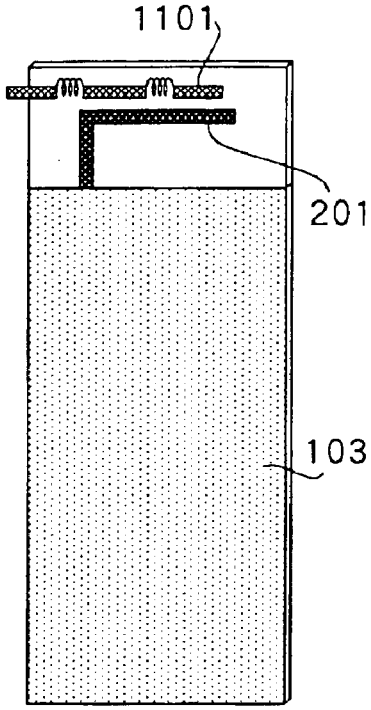
FIG. 16 is a diagram of a cellular phone antenna according to Embodiment 7 of the present invention.

FIG. 16 is a diagram of a cellular phone antenna according to Embodiment 7 of the present invention. However, parts in FIG. 16 common to those in FIG. 7 are assigned the same reference numerals as those in FIG. 7 and detailed explanations thereof will be omitted.

FIG. 16 differs from FIG. 7 in that a passive element 1101 with two inductances (inductive elements) is provided instead of the passive element 202 in FIG. 7.

With both ends left open, the passive element 1101 is provided with two inductances at intermediate positions of the element, the length of the portion of the element sandwiched between the two inductances is set to a length of resonance at a high frequency and the entire length including the two inductances is set to a length of resonance at a low frequency. Furthermore, the passive element 1101 is placed in substantially parallel to the width direction of the circuit substrate 103 at a distance of approximately 1/10 or less of the wavelength at the operating frequency from the unbalanced feeding antenna element 201.

Then, the operation of the cellular phone antenna in the above-described configuration will be explained. The unbalanced feeding antenna element 201 is mainly operated as an excitation element. The passive element 1101 is constructed in such a way as to resonate at two frequencies and when the portion of the element sandwiched between the two inductances resonates with the excitation of the unbalanced feeding antenna element 201, it operates as the antenna corresponding to the higher frequency. On the other hand, when the entire passive element 1101 including the inductances resonates with the excitation of the unbalanced feeding antenna element 201, it operates as the antenna corresponding to the lower frequency. This also allows this embodiment to be applied to a communication system using two frequencies. Furthermore, since the passive element 1101 is located close to the unbalanced feeding antenna element 201, radiation from the passive element 1101 becomes dominant, which allows the current flowing into the circuit substrate 103 to be suppressed to a minimum level. When the user uses the cellular phone, this reduces radiation from the portion held by the hand (circuit substrate 103), and on the contrary, it can enhance radiation from the upper section of the cellular phone which is less affected by the human body.

Thus, according to the cellular phone antenna of Embodiment 7, radiation from the passive element becomes dominant compared to radiation from the circuit substrate and unlike Embodiment 1, two inductances are provided at intermediate positions of the passive element, and this embodiment can thereby realize an antenna with horizontal polarization having two resonant frequencies, thus making it also possible to suppress a reduction in the antenna gain caused by the human body when the cellular phone is used.

(Embodiment 8)

Figure 17:
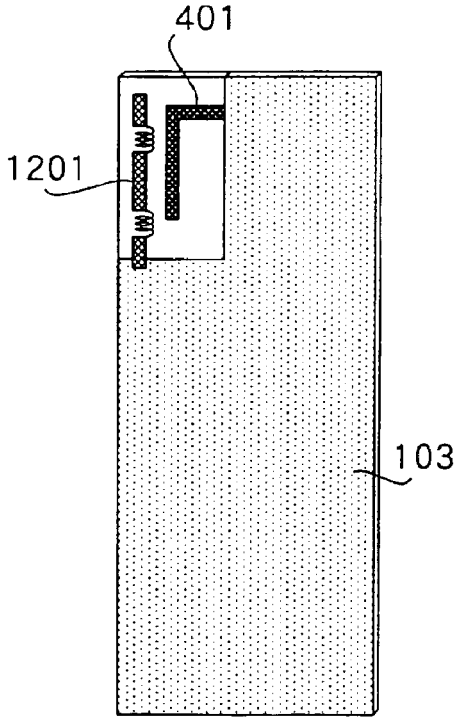
FIG. 17 is a diagram of a cellular phone antenna according to Embodiment 8 of the present invention.

FIG. 17 is a diagram of a cellular phone antenna according to Embodiment 8 of the present invention. However, parts in FIG. 17 common to those in FIG. 9 are assigned the same reference numerals as those in FIG. 9 and detailed explanations thereof will be omitted.

FIG. 17 differs from FIG. 9 in that a passive element 1201 with two inductances (inductive elements) is provided instead of the passive element 402 in FIG. 9.

With both ends left open, the passive element 1201 is provided with two inductances at intermediate positions of the element, the length of the portion of the element sandwiched between the two inductances is set to a length of resonance at a high frequency and the entire length including the two inductances is set to a length of resonance at a low frequency. Furthermore, the passive element 1201 is placed in substantially parallel to the longitudinal direction of the circuit substrate 103 at a distance of approximately 1/10 or less of the wavelength at the operating frequency from the unbalanced feeding antenna element 401.

Then, the operation of the cellular phone antenna in the above-described configuration will be explained. The unbalanced feeding antenna element 401 is mainly operated as an excitation element. The passive element 1201 is constructed in such a way as to resonate at two frequencies and when the portion of the element sandwiched between the two inductances resonates with the excitation of the unbalanced feeding antenna element 401, it operates as the antenna corresponding to the higher frequency. On the other hand, when the entire passive element 1201 including the inductances resonates with the excitation of the unbalanced feeding antenna element 401, it operates as the antenna corresponding to the lower frequency. This also allows this embodiment to be applied to a communication system using two frequencies. Furthermore, since the passive element 1201 is located close to the unbalanced feeding antenna element 401, radiation from the passive element 1201 becomes dominant, which allows the current flowing into the circuit substrate 103 to be suppressed to a minimum level. When the user uses the cellular phone, this reduces radiation from the portion held by the hand (circuit substrate 103), and on the contrary, it can enhance radiation from the upper section of the cellular phone which is less affected by the human body.

Thus, unlike Embodiment 7, the cellular phone antenna of Embodiment 8 places the unbalanced feeding antenna element and passive element substantially in parallel to the longitudinal direction of the cellular phone, and can thereby realize an antenna with vertical polarization having two resonant frequencies and make radiation from the passive element dominant compared to radiation from the circuit substrate, thus making it also possible to suppress a reduction in the antenna gain caused by the human body when the cellular phone is used.

(Embodiment 9)

Figure 18:
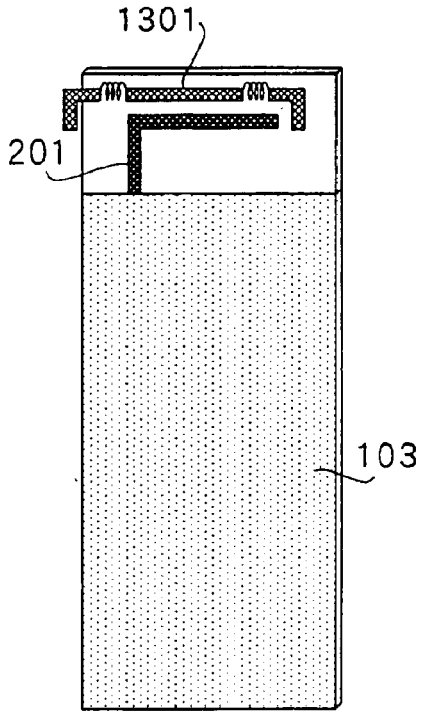
FIG. 18 is a diagram of a cellular phone antenna according to Embodiment 9 of the present invention.

FIG. 18 is a diagram of a cellular phone antenna according to Embodiment 9 of the present invention. However, parts in FIG. 18 common to those in FIG. 16 are assigned the same reference numerals as those in FIG. 16 and detailed explanations thereof will be omitted.

FIG. 18 differs from FIG. 16 in that a passive element 1301 which is provided with two inductances and bent at a quasi-right angle at a predetermined distance from both ends is provided instead of the passive element 1101 in FIG. 16.

With both ends left open, the passive element 1301 is provided with two inductances at intermediate positions of the element, the length of the portion of the element sandwiched between the two inductances is set to a length of resonance at a high frequency and the entire length including the two inductances is set to a length of resonance at a low frequency. Furthermore, the passive element 1301 is bent at a quasi-right angle at a predetermined distance from both ends and the side not including open both ends is placed in substantially parallel to the width direction of the circuit substrate 103 at a distance of approximately 1/10 or less of the wavelength at the operating frequency from the unbalanced feeding antenna element 201.

Then, the operation of the cellular phone antenna in the above-described configuration will be explained. The unbalanced feeding antenna element 201 is mainly operated as an excitation element. The passive element 1301 is constructed in such a way as to resonate at two frequencies and when the portion of the element sandwiched between the two inductances resonates with the excitation of the unbalanced feeding antenna element 201, it operates as the antenna corresponding to the higher frequency. On the other hand, when the entire passive element 1301 including the inductances resonates with the excitation of the unbalanced feeding antenna element 201, it operates as the antenna corresponding to the lower frequency. This allows this embodiment to be applied to a communication system using two frequencies, too. Furthermore, since part of the passive element 1301 is placed in substantially parallel to the longitudinal direction of the circuit substrate 103, it can also handle vertical polarization and realize an antenna corresponding to both vertical and horizontal polarizations. Furthermore, since the passive element 1301 is located close to the unbalanced feeding antenna element 201, radiation from the passive element 1301 becomes dominant, which allows the current flowing into the circuit substrate 103 to be suppressed to a minimum level. When the user uses the cellular phone, this reduces radiation from the portion held by the hand, and on the contrary, it can enhance radiation from the upper section of the cellular phone which is less affected by the human body.

Thus, unlike Embodiment 7, the cellular phone antenna of Embodiment 9 has the passive element bent at a quasi-right angle at a predetermined distance from both ends thereof, and can thereby realize an antenna with vertical and horizontal polarizations having two resonant frequencies and make radiation from the passive element dominant compared to radiation from the circuit substrate, thus making it also possible to suppress a reduction in the antenna gain caused by the human body when the cellular phone is used.

(Embodiment 10)

Figure 19:
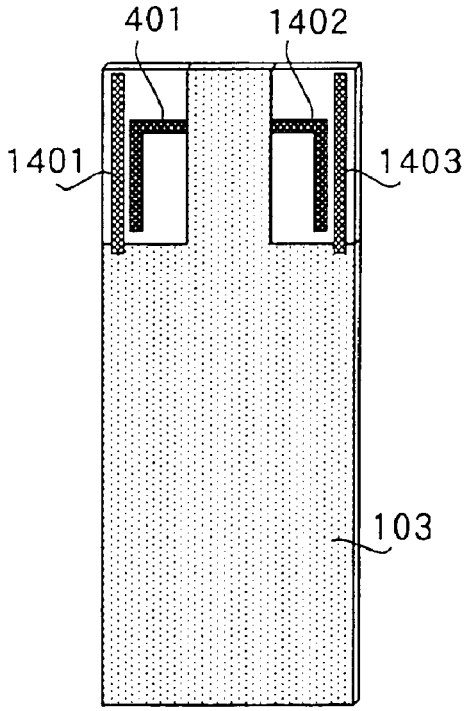
FIG. 19 is a diagram of a cellular phone antenna according to Embodiment 10 of the present invention.

FIG. 19 is a diagram of a cellular phone antenna according to Embodiment 10 of the present invention. However, parts in FIG. 19 common to those in FIG. 9 are assigned the same reference numerals as those in FIG. 9 and detailed explanations thereof will be omitted.

With both ends left open, the passive element 1401 is set to a length of resonance at an operating frequency and placed in substantially parallel to the longitudinal direction of the circuit substrate 103 at a distance of approximately 1/10 or less of the wavelength at the operating frequency from the unbalanced feeding antenna element 401.

Assuming a virtual line that divides the length in the width direction of the circuit substrate 103 into equal portions, the unbalanced feeding antenna element 1402 is placed in such a way as to be symmetric to the unbalanced feeding antenna element 401 with respect to the virtual line.

With both ends left open, the passive element 1403 has substantially the same length as the length of the passive element 1401 and is placed in substantially parallel to the longitudinal direction of the circuit substrate 103 at a distance of approximately 1/10 or less of the wavelength at the operating frequency from the unbalanced feeding antenna element 1402.

Then, the operation of the cellular phone antenna in the above-described configuration will be explained. The unbalanced feeding antenna element 401 or the unbalanced feeding antenna element 1402 is mainly operated as an excitation element. When the unbalanced feeding antenna element 401 is operated as an excitation element, the passive element 1401 resonates and operates as an antenna. On the other hand, when the unbalanced feeding antenna element 1402 is operated as an excitation element, the passive element 1403 resonates and operates as an antenna. This makes it possible to realize a diversity antenna.

In this way, the cellular phone antenna of Embodiment 10 provides two sets of an unbalanced feeding antenna element combined with a passive element, and can thereby realize a diversity antenna with vertical polarization, perform more stable transmission/reception and make radiation from the passive element dominant compared to radiation from the circuit substrate, thus making it also possible to suppress a reduction of the antenna gain caused by the human body when the cellular phone is used.

(Embodiment 11)

Figure 20:
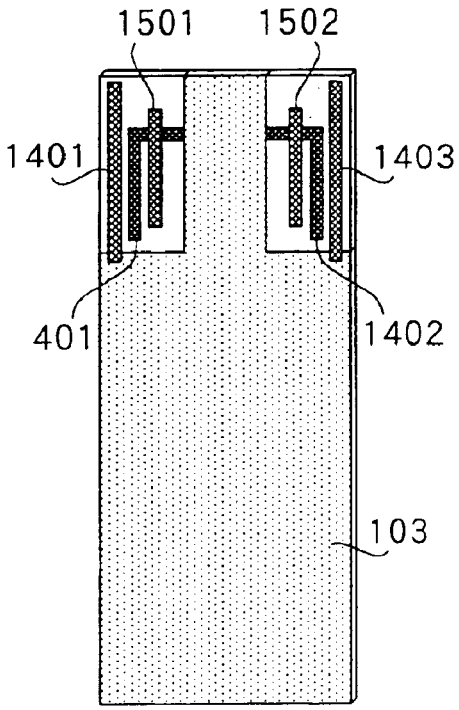
FIG. 20 is a diagram of a cellular phone antenna according to Embodiment 11 of the present invention.

FIG. 20 is a diagram of a cellular phone antenna according to Embodiment 11 of the present invention. However, parts in FIG. 20 common to those in FIG. 19 are assigned the same reference numerals as those in FIG. 19 and detailed explanations thereof will be omitted.

With both ends left open, the passive element 1501 is set to a length of resonance at an operating frequency different from that of the passive element 1401 and placed in substantially parallel to the longitudinal direction of the circuit substrate 103 at a distance of approximately 1/10 or less of the wavelength at the operating frequency, which is different from the frequency used by the passive element 1401 and the passive element 1403, from the unbalanced feeding antenna element 1401.

The passive element 1502 has the same configuration as that of the passive element 1501 and is placed in substantially parallel to the longitudinal direction of the circuit substrate 103 at a distance of approximately 1/10 or less of the wavelength at the operating frequency, which is different from the frequency used by the passive element 1401 and the passive element 1403, from the unbalanced feeding antenna element 1402.

Then, the operation of the cellular phone antenna in the above-described configuration will be explained. The unbalanced feeding antenna element 401 or the unbalanced feeding antenna element 1402 is mainly operated as an excitation element.

When the unbalanced feeding antenna element 401 is operated as an excitation element, the passive element 1401 or the passive element 1501 operates as an antenna. At this time, the passive element 1401 and the passive element 1501 have different element lengths, and therefore this embodiment can handle two frequencies and is also applicable to a communication system using two frequencies.

On the other hand, when the unbalanced feeding antenna element 1402 is operated as an excitation element, the passive element 1403 or the passive element 1502 resonates and operates as an antenna. Since the passive element 1401 and the passive element 1501 have different element lengths, this embodiment can handle two frequencies and is also applicable to a communication system using two frequencies. This makes it possible to realize a diversity antenna handling two frequencies.

In this way, unlike Embodiment 10, the cellular phone antenna of Embodiment 11 provides two sets of an unbalanced feeding antenna element combined with two passive elements of different lengths, and can thereby realize a diversity antenna with vertical polarization corresponding to two frequencies, provide more stable transmission/reception and make radiation from the passive elements dominant compared to radiation from the circuit substrate, thus making it also possible to suppress a reduction of the antenna gain caused by the human body when the cellular phone is used.

(Embodiment 12)

Figure 21:
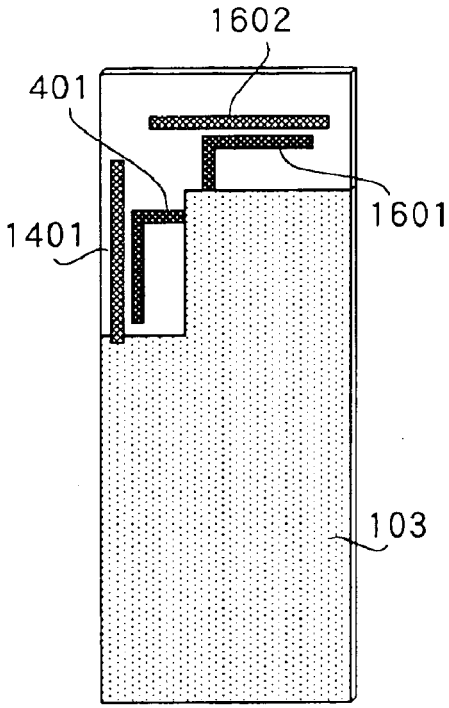
FIG. 21 is a diagram of a cellular phone antenna according to Embodiment 12 of the present invention.

FIG. 21 is a diagram of a cellular phone antenna according to Embodiment 12 of the present invention. However, parts in FIG. 21 common to those in FIG. 19 are assigned the same reference numerals as those in FIG. 19 and detailed explanations thereof will be omitted.

The unbalanced feeding antenna element 1601 is bent at a quasi-right angle and its one end is connected to a feeding point (not shown) on the circuit substrate. On the other hand, the side having one end not connected to the feeding point is placed in substantially parallel to the width direction of the circuit substrate 103.

The passive element 1602 has the same configuration as that of the passive element 1401 and is placed in substantially parallel to the width direction of the circuit substrate 103 at a distance of approximately 1/10 or less of the wavelength at the operating frequency from the unbalanced feeding antenna element 1601.

The unbalanced feeding antenna elements 401 and 1601, and passive elements 1401 and 1602 are placed at the upper section of the cellular phone when the circuit substrate 103 is mounted in the cellular phone.

Then, the operation of the cellular phone antenna in the above-described configuration will be explained. The unbalanced feeding antenna element 401 or the unbalanced feeding antenna element 1601 is mainly operated as an excitation element.

When the unbalanced feeding antenna element 401 is operated as an excitation element, the passive element 1401 resonates and operates as an antenna. This makes it possible to realize an antenna with vertical polarization.

On the other hand, when the unbalanced feeding antenna element 1601 is operated as an excitation element, the passive element 1602 resonates and operates as an antenna. This makes it possible to realize an antenna with horizontal polarization.

In this way, unlike Embodiment 10, the cellular phone antenna of Embodiment 12 provides one set of an unbalanced feeding antenna element combined with a passive element substantially in parallel to the longitudinal direction of the cellular phone and the other set substantially perpendicular to the longitudinal direction of the cellular phone, and can thereby realize a diversity antenna corresponding to vertical and horizontal polarizations, provide more stable transmission/reception and make radiation from the passive element dominant compared to radiation from the circuit substrate, thus making it also possible to suppress a reduction of the antenna gain caused by the human body when the cellular phone is used.

(Embodiment 13)

Figure 22:
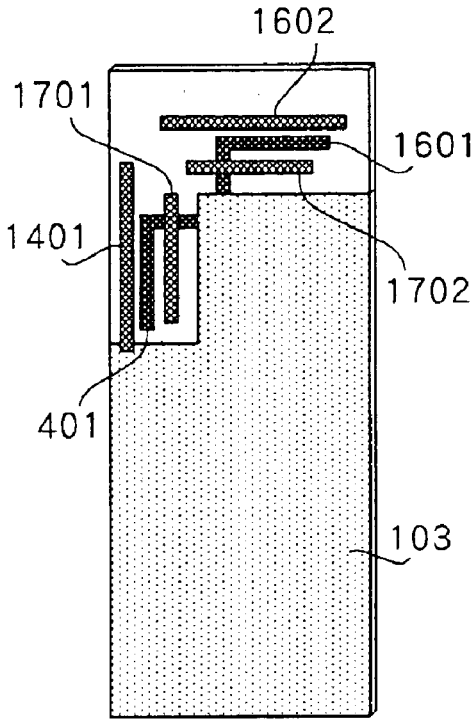
FIG. 22 is a diagram of a cellular phone antenna according to Embodiment 13 of the present invention.

FIG. 22 is a diagram of a cellular phone antenna according to Embodiment 13 of the present invention. However, parts in FIG. 22 common to those in FIG. 21 are assigned the same reference numerals as those in FIG. 21 and detailed explanations thereof will be omitted.

With both ends left open, the passive element 1701 is set to a length of resonance with an operating frequency, which is different from that of the passive element 1401 and placed in substantially parallel to the longitudinal direction of the circuit substrate 103 at a distance of approximately 1/10 or less of the wavelength at the operating frequency, which is different from the frequencies used by the passive element 1401 and passive element 1602, from the unbalanced feeding antenna element 401.

The passive element 1702 has the same configuration as that of the passive element 1701 and is placed in substantially parallel to the width direction of the circuit substrate 103 at a distance of approximately 1/10 of or less of the wavelength at the operating frequency, which is different from the frequencies used by the passive element 1401 and passive element 1602, from the unbalanced feeding antenna element 1601.

Then, the operation of the cellular phone antenna in the above-described configuration will be explained. The unbalanced feeding antenna element 401 or the unbalanced feeding antenna element 1601 is mainly operated as an excitation element.

When the unbalanced feeding antenna element 401 is operated as an excitation element, the passive element 1401 or the passive element 1701 resonates and operates as an antenna. Since the passive element 1401 and the passive element 1701 have different element lengths at this time, this embodiment can realize an antenna with vertical polarization handling two frequencies and is applicable to a communication system using two frequencies, too.

On the other hand, when the unbalanced feeding antenna element 1601 is operated as an excitation element, the passive element 1602 or the passive element 1702 resonates and operates as an antenna. Since the passive element 1602 and the passive element 1702 have different element lengths at this time, this embodiment can realize an antenna with horizontal polarization handling two frequencies. In this way, this embodiment can realize a diversity antenna with vertical and horizontal polarizations handling two frequencies.

In this way, unlike Embodiment 12, the cellular phone antenna of Embodiment 13 provides two sets of an unbalanced feeding antenna element combined with two passive elements of different lengths, and can thereby realize a diversity antenna with vertical and horizontal polarizations handling two frequencies, provide more stable transmission/reception and make radiation from the passive elements dominant compared to radiation from the circuit substrate, thus making it also possible to suppress a reduction of the antenna gain caused by the human body when the cellular phone is used.

(Embodiment 14)

Figure 23:
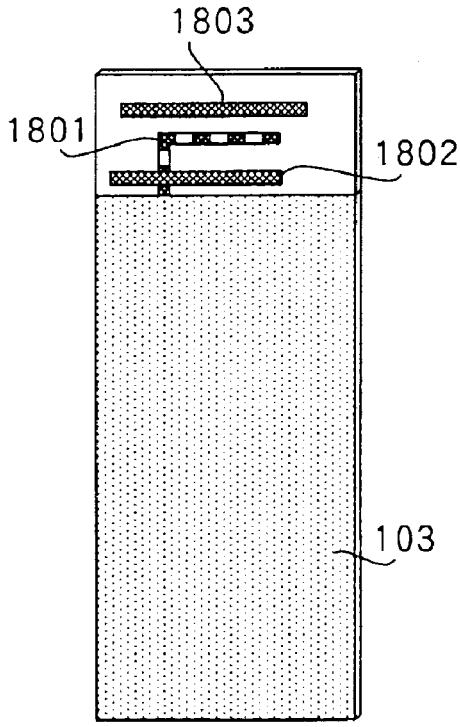
FIG. 23 is a diagram of a cellular phone antenna according to Embodiment 14 of the present invention.

FIG. 23 is a diagram of a cellular phone antenna according to Embodiment 14 of the present invention. The antenna in FIG. 23 comprises a circuit substrate 103 provided with an unbalanced feeding antenna element 1801, a passive element 1802 and a passive element 1803 and each element is printed on the circuit substrate 103.

Embodiment 14 is applicable to the unbalanced feeding antenna elements and passive elements used in Embodiment 1 to Embodiment 13 and can be constructed by printing those elements on either side of the circuit substrate.

This makes it possible to realize a thin, low-cost and simple cellular phone antenna.

(Embodiment 15)

Figure 24:
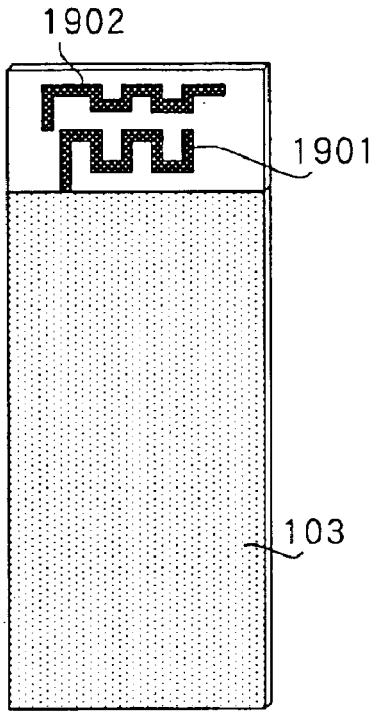
FIG. 24 is a diagram of a cellular phone antenna according to Embodiment 15 of the present invention.

FIG. 24 is a diagram of a cellular phone antenna according to Embodiment 15 of the present invention. The antenna shown in FIG. 24 comprises a zigzag unbalanced feeding antenna element 1901 and a zigzag passive element 1902.

Embodiment 15 is applicable to the unbalanced feeding antenna elements and passive elements used in Embodiment 1 to Embodiment 14 and can be constructed by zigzag-shaping those elements.

This makes it possible to realize a smaller cellular phone antenna without reducing the antenna gain.

(Embodiment 16)

Figure 25:
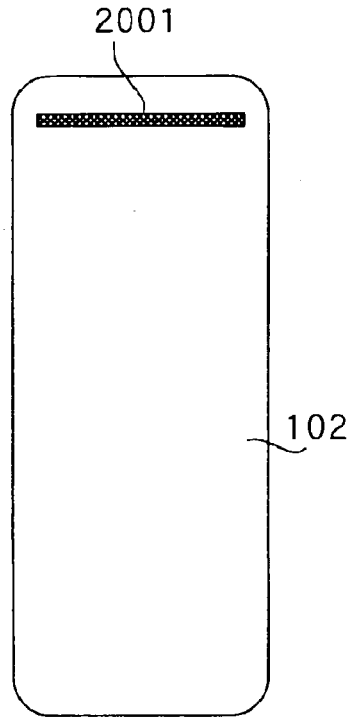
FIG. 25 is a diagram of a cellular phone antenna according to Embodiment 16 of the present invention.
Figure 26:
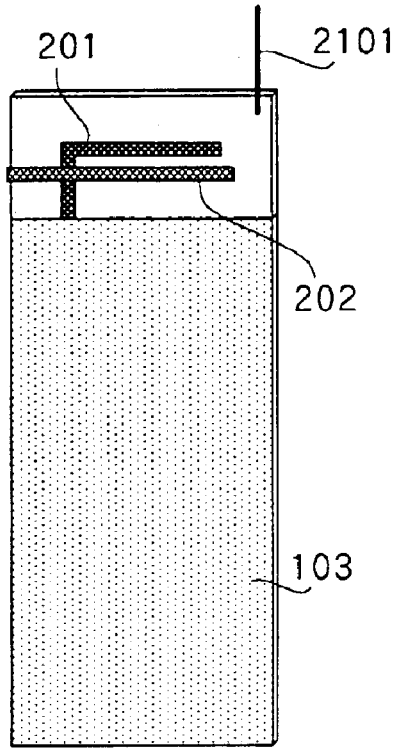
FIG. 26 is a diagram of a cellular phone antenna according to another embodiment of the present invention.
Figure 27:
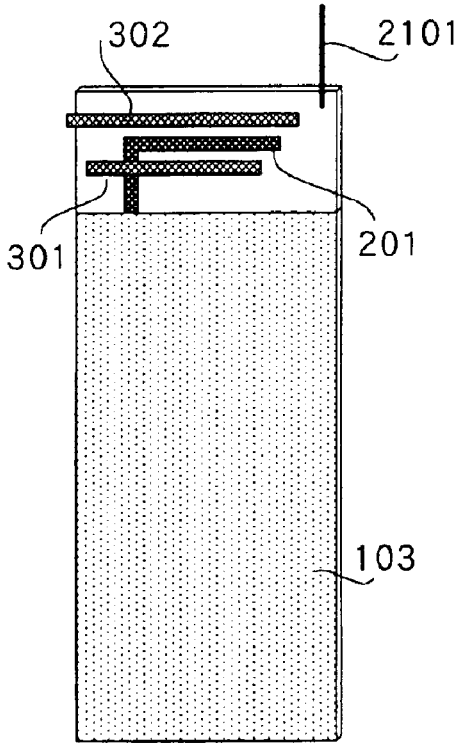
FIG. 27 is a diagram of a cellular phone antenna according to a further embodiment of the present invention.
Figure 28:
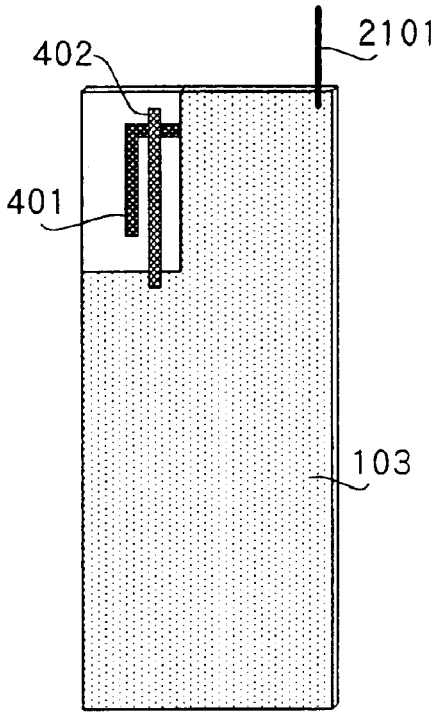
FIG. 28 is a diagram of a cellular phone antenna according to a still further embodiment of the present invention.
Figure 29:
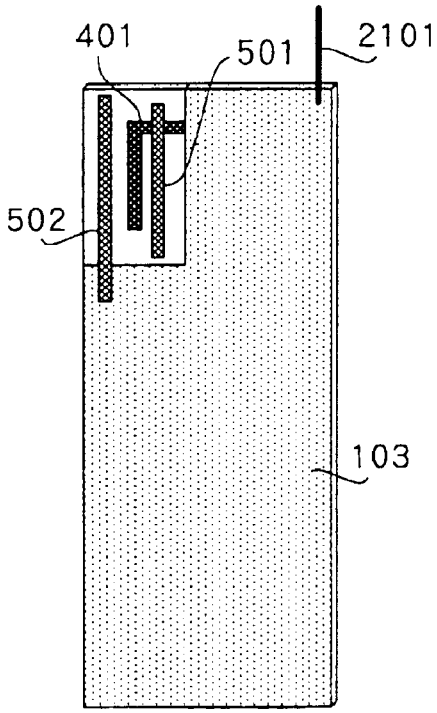
FIG. 29 is a diagram of a cellular phone antenna according to a still further embodiment of the present invention.
Figure 30:
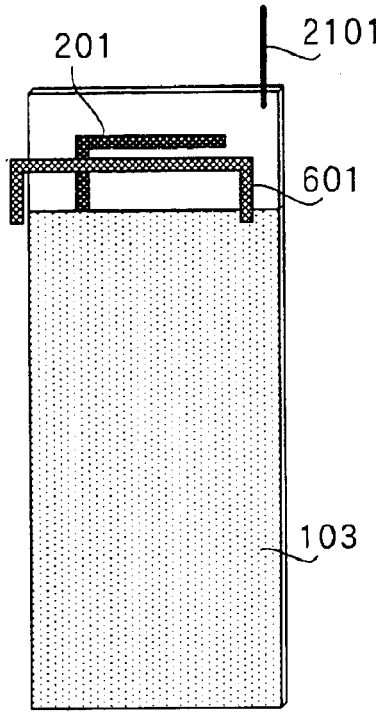
FIG. 30 is a diagram of a cellular phone antenna according to a still further embodiment of the present invention.
Figure 31:
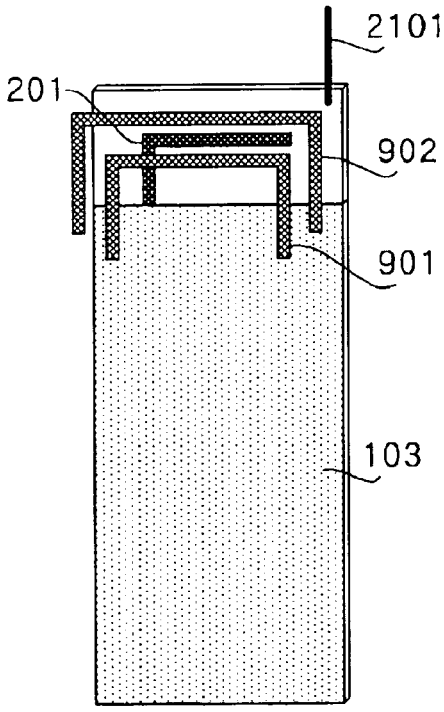
FIG. 31 is a diagram of a cellular phone antenna according to a still further embodiment of the present invention.
Figure 32:
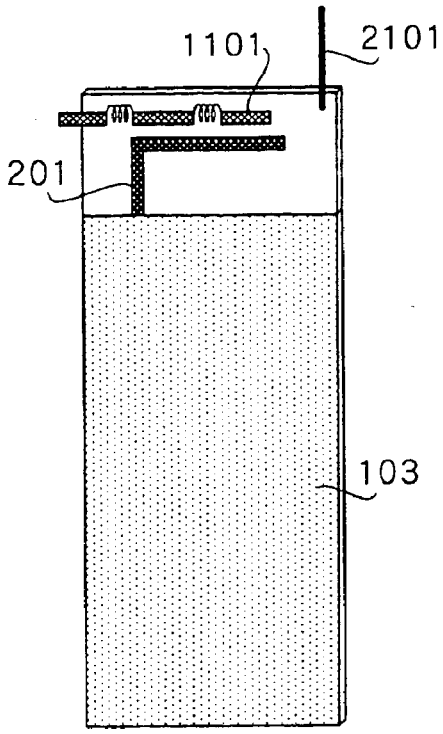
FIG. 32 is a diagram of a cellular phone antenna according to a still further embodiment of the present invention.
Figure 33:
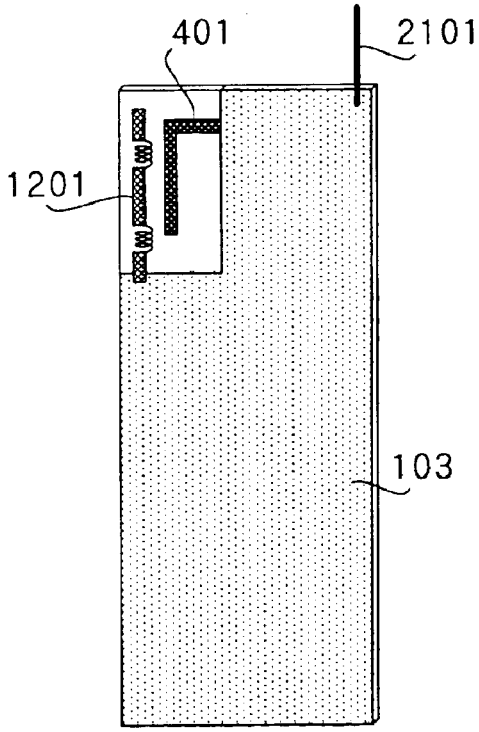
FIG. 33 is a diagram of a cellular phone antenna according to a still further embodiment of the present invention.
Figure 34:
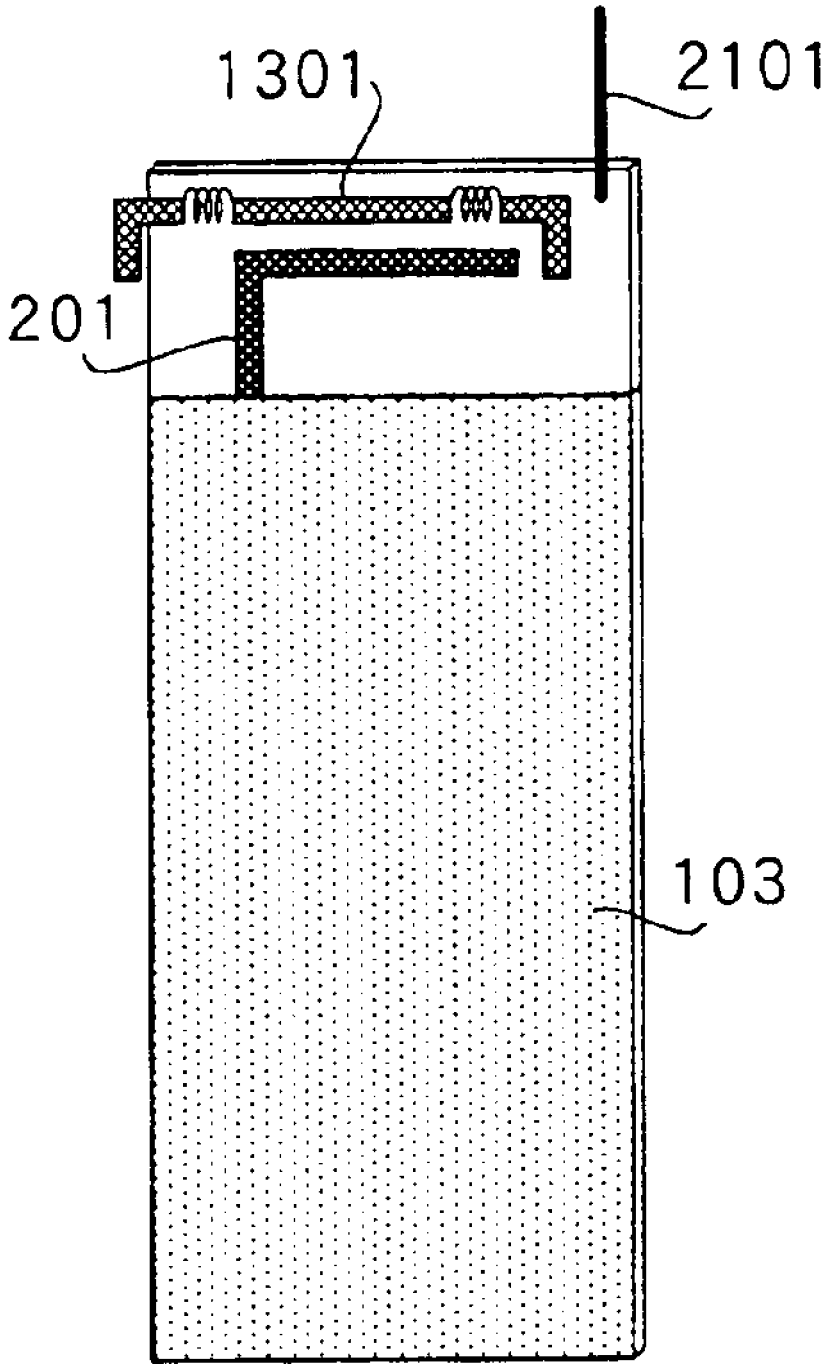
FIG. 34 is a diagram of a cellular phone antenna according to a still further embodiment of the present invention.

FIG. 25 is a diagram of a cellular phone antenna according to Embodiment 16 of the present invention. FIG. 25 shows a structure with a passive element 2001 bonded or vapor deposited on to the inner surface or outer surface of a rear case 102.

Embodiment 16 is applicable to the passive elements used in Embodiment 1 to Embodiment 13 and Embodiment 15 and can be constructed bonded onto the rear case 102.

This makes it possible to save the antenna mounting space and realize a low-cost cellular phone antenna.

(Other Embodiments)

Embodiment 1 to Embodiment 9 can realize a diversity antenna by providing an external antenna 2101 as shown in FIG. 26 to FIG. 34.

It is also possible to apply Embodiment 14 to Embodiment 16 to the diversity antenna provided with this external antenna.

Embodiments 1 to 13 described above have described directions in which unbalanced feeding antenna elements and passive elements are arranged with respect to the circuit substrate, but these elements can also be rearranged with respect to the case (housing). In short, it is important to place a passive element close to an unbalanced feeding antenna element substantially in parallel thereto.

For convenience of explanation, the above embodiments have been described assuming a rectangular circuit substrate, but the present invention is not limited to this. Moreover, the above embodiments have been described with an example of a cellular phone, but the present invention is not limited to this and is more widely applicable to a communication terminal apparatus.

As described above, the present invention places a passive element substantially in parallel to an unbalanced feeding antenna element at a distance of approximately 1/10 or less of the wavelength at its frequency, and can thereby suppress the antenna current that flows into the circuit substrate to a minimum level, make radiation from the passive element dominant and thereby suppress a reduction in the antenna gain caused by the human body.

This application is based on the Japanese Patent Application No. 2001-398231 filed on Dec. 27, 2001, entire content of which is expressly incorporated by reference herein.

Industrial Applicability

The present invention relates to an antenna used for a radio set and portable terminal, etc., and is preferably applicable to a built-in antenna of a radio set and portable terminal, etc.

What is claimed is:

1. An antenna for a communication terminal apparatus, the antenna comprising:

a first feeding element and a second feeding element, wherein an end of the first or second feeding element is fed with power in an unbalanced manner;

a first passive element placed substantially in parallel to said first feeding element at a distance of approximately 1/10 or less of the wavelength at a frequency used for transmission/reception, the first passive element having a length of resonance when said first feeding element is excited; and a second passive element placed substantially in parallel to said second feeding element at a distance of approximately 1/10 or less of the wavelength at the frequency used for said transmission/reception, the second passive element having a length of resonance when said second feeding element is excited, wherein:

said first feeding element, said second feeding element, said first passive element, and said second passive element are placed at positions distant from the position at which a user of the communication terminal apparatus holds said communication terminal apparatus.

2. The antenna for a communication terminal apparatus according to claim 1, further comprising:

a third passive element differing in length from said first passive element, the first passive element having the same length as that of said second passive element, and a fourth passive element having the same length as that of said third passive element, wherein:

said third passive element is placed substantially in parallel to said first feeding element at a distance of approximately 1/10 or less of the wavelength of a frequency different from the frequency used for transmission/reception by said first passive element and said second passive element, and said fourth passive element is placed in substantially parallel to said second feeding element at a distance of approximately 1/10 or less of the wavelength of the frequency different from the frequency used for transmission/reception by said first passive element and said second passive element.

3. The antenna for a communication terminal apparatus according to claim 1, wherein said first feeding element and said second feeding element are placed in such a way that the angle formed by the orientation of said first feeding element and the orientation of said second feeding element is substantially a right angle.

* * * * *